United States Patent [19]

Adams

[11] 4,185,566

[45] Jan. 29, 1980

[54] BENDIBLE BRACKET

[76] Inventor: Carl Adams, 7255 Fulton Ave., North Hollywood, Calif. 91605

[21] Appl. No.: 813,959

[22] Filed: Jul. 8, 1977

[51] Int. Cl.[2] ..... A47F 5/00

[52] U.S. Cl. ..... 108/152; 248/248; 248/250

[58] Field of Search ..... 248/248, 250, DIG. 9, 248/300; 108/152; 211/90; 29/150

[56] References Cited

U.S. PATENT DOCUMENTS

| | | | |
|---|---|---|---|
| 852,975 | 5/1907 | Morgan | 248/248 |
| 2,429,586 | 10/1947 | Rompre | 248/248 |
| 2,432,241 | 12/1947 | Kerr | 248/248 |
| 2,777,583 | 1/1957 | Beltz | 248/248 X |
| 3,471,111 | 10/1969 | MacDonald | 248/250 X |
| 3,702,591 | 11/1972 | Banse | 211/90 |
| 4,039,137 | 8/1977 | Smith | 248/248 |

FOREIGN PATENT DOCUMENTS

| | | | |
|---|---|---|---|
| 2309060 | 9/1973 | Fed. Rep. of Germany | 248/DIG. 9 |
| 16034 | of 1896 | United Kingdom | 248/248 |
| 566891 | 1/1945 | United Kingdom | 248/247 |

*Primary Examiner*—Roy D. Frazier
*Assistant Examiner*—Peter A. Aschenbrenner
*Attorney, Agent, or Firm*—Victor Sepulveda

[57] ABSTRACT

Herein described is a bendible bracket useful, for example, in securing shelves or the like to a wall which includes elongated members preformed during manufacturing and packaged in an unbent condition. These brackets are then capable of being bent into the desired angle and secured to a wall so that shelves or the like may be attached thereto.

9 Claims, 7 Drawing Figures

Fig. 6
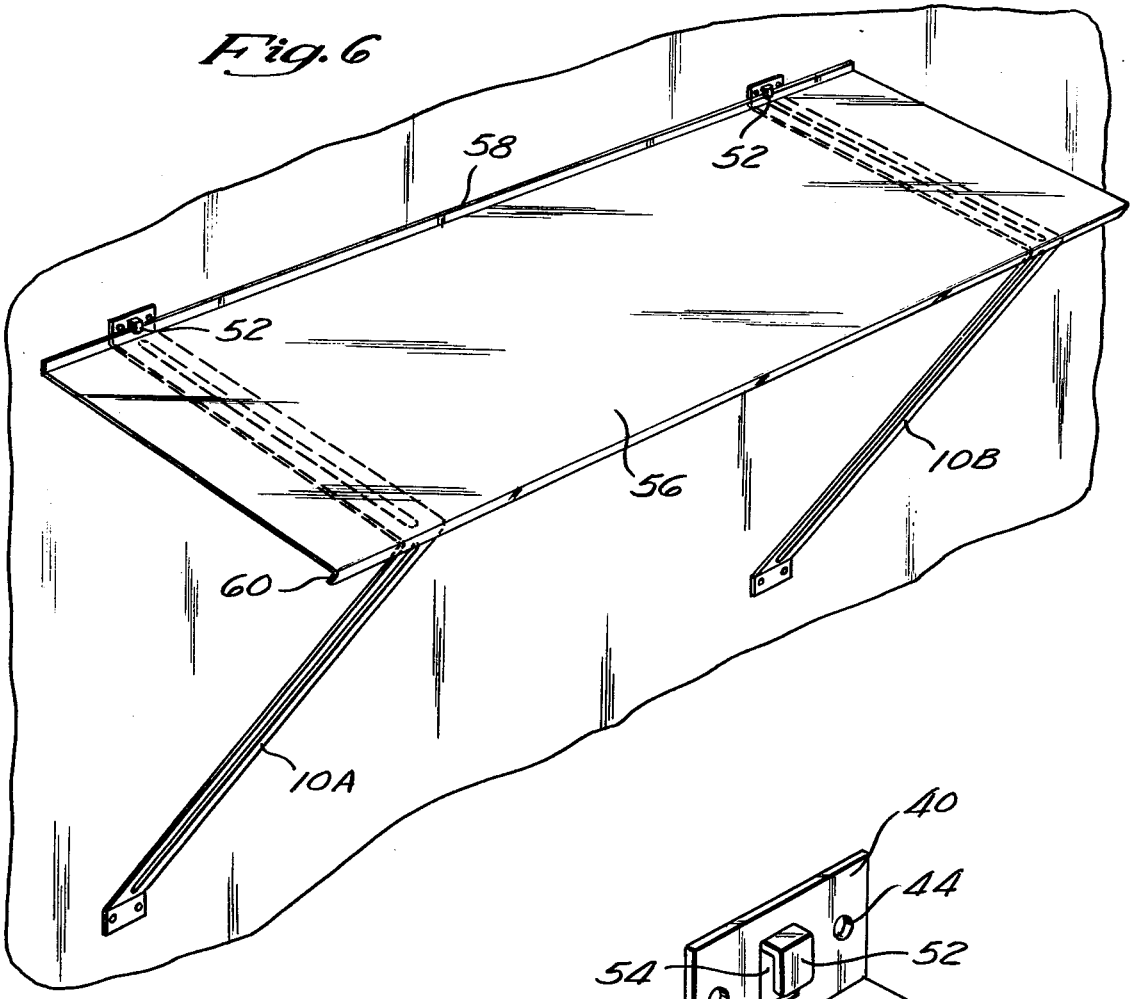
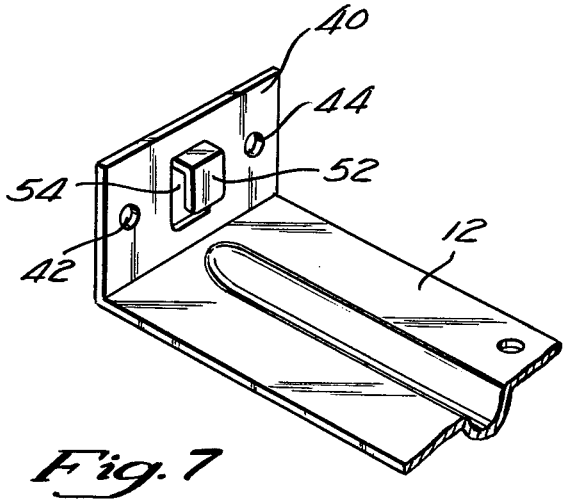
Fig. 7

BENDIBLE BRACKET

BACKGROUND OF THE INVENTION

This invention relates to brackets and more particularly to shelf brackets useful for securing shelves or the like to the wall.

Heretofore shelf brackets are normally constructed of a strip of metallic substance and bent at a 90 degree angle and includes a wall plate section and a shelf holding extension. Such brackets extend 90 degrees outward from the wall plate and, in some instances, a second brace is attached between the wall plate and the extending plate for strength and rigidity.

SUMMARY OF THE INVENTION

The present invention comprises a metal strip which may be galvanized and formed by a stamping operation and having a flange adapted to be bent at an angle. On either end of the bracket is a pair of upwardly extending ends thereof which can be secured to a vertical wall. The bracket is then bent to its desired shape and secured to the vertical wall.

A bead is placed along the elongated section of the strip to add rigidity and strength to the bracket. Two pairs of dimples are provided at predetermined distance from one end of the bracket and spaced so that when the bracket is bent along a predetermined line the bend is straight and defines a very small radius which adds strength and rigidity to the bracket.

By this method the need for a wall plate is eliminated and also the need of a brace between the outward extending portion and the wall plate. In fact, the bracing is provided by the bracket itself rather than adding materials thereto.

DESCRIPTION OF THE DRAWINGS

These and other features and advantages will become more apparent to those skilled in the art when taken into consideration with the following detailed description wherein like reference numerals indicate like and corresponding parts throughout the several views and wherein:

FIG. 6 is a perspective view showing a further embodiment of the present invention illustrating a shelf attached to the shelf brackets which in turn are attached to a vertical wall;

FIG. 7 is a partial view of one end of the present invention illustrating the tang on the wall plate to secure a sheet metal plate thereto.

DESCRIPTION OF THE SHOWN EMBODIMENT

Figure 1:
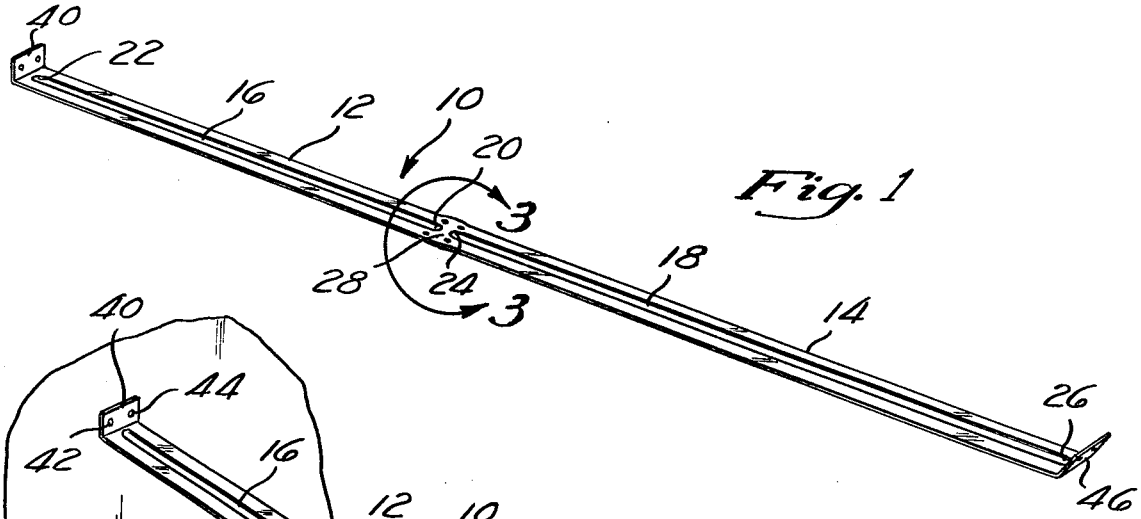
FIG. 1 is a perspective view of the shelf bracket of the present invention shown in an unbent condition.
Figure 2:
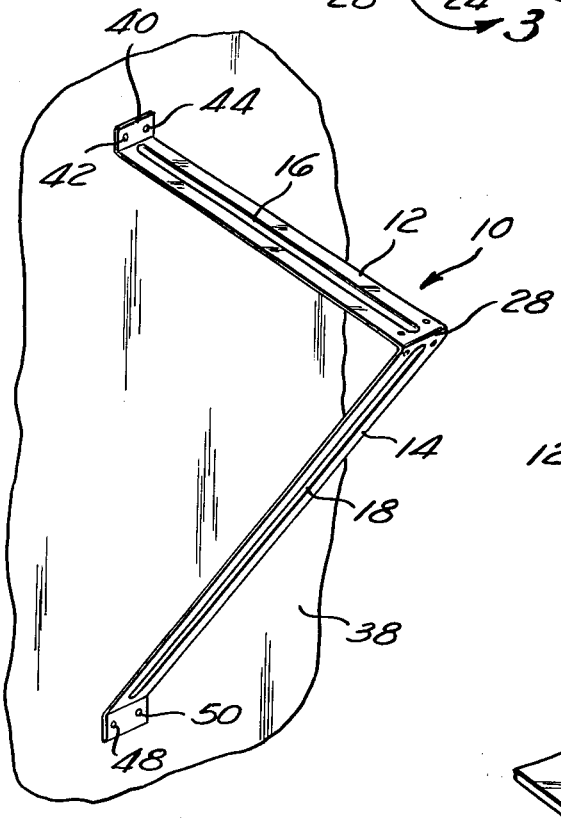
FIG. 2 is a perspective view of the shelf bracket of the present invention after it has been bent and secured to a vertical wall.

Turning now to a more detailed description of the present invention there is shown in FIG. 1 a shelf bracket which when bent at a certain area as hereinafter to be described, it appears substantially as shown in FIG. 2 secured to a vertical wall. Thereafter shelves may be attached to the bracket in a suitable manner and in a manner shown in one embodiment.

Figure 3:
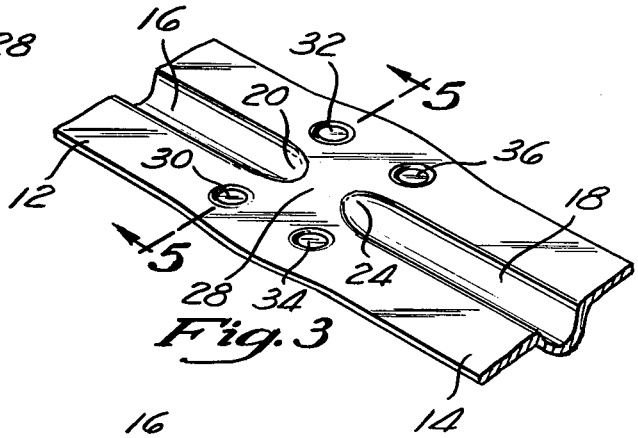
FIG. 3 is an enlarged view of the bending area of the present invention.
Figure 4:
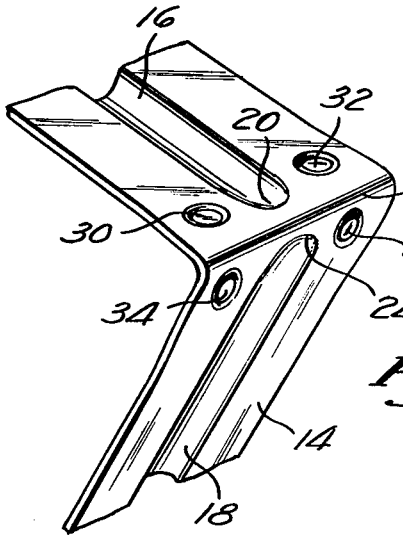
FIG. 4 is a same view as FIG. 3 showing the bracket at its bending location.
Figure 5:
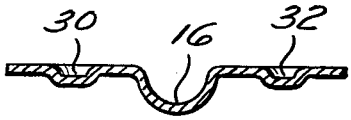
FIG. 5 is a section view taken along the lines 5—5 of FIG. 3.

Referring specifically to FIG. 1 the bracket is shown in an elongated position which includes a first end 12 and second end 14, the second end 12 being substantially longer than the first end 14. Each end 12 and 14 has a bead therein which runs almost the entire length of the end 12 and the end 14. The bead is best shown in FIGS. 3, 4, and 5. The bead 18 may desirably be deeper than the bead 16. Bead runs from a starting point 20 to a point 22 on the other end of first end 12 and is done by pressing or stamping which is well known to those skilled in the art. Also on end 14 is a similar bead 18 which runs from the position 24 to the area 26 and terminates on each end and is pressed or stamped in the manner set forth in connection with the end 12.

The area 28 defined between the termination end 24 of bead 18 and the termination end of bead 16 is the bend area of the bracket to assure a straight bend. Two pairs of dimples 30, 32 and 34, 36 are pressed on either side of the bracket and one either side of the bend area so that the bend when made will be made in a straight line. Also, because of the distance between the set of dimples 30 and 32 and 34 and 36 is kept to a minimum, the radius of the bend is also kept at a minimum thereby assuring a small radius for strength.

To secure the bracket of the present invention to a vertical wall such as the wall 38 in FIG. 2 the end 40 of the bracket 10 is turned upwardly at a 90 degree angle and has a pair of holes 42 and 44 therein so that it may be secured to the wall 38 by suitable fastening such as nails or screws. The present invention operates very well and has sufficient strength with ordinary nails. The bend 40 is normally at a 90 degree angle so that the shelf can protrude normal to the vertical of the wall 38. The end 46 of the bracket 10 is bent at any suitable angle depending on the length of the bracket 18 so that it also may sit flush against the wall by suitable fastening means such as screws or nails through holes 48 and 50.

Referring now to FIGS. 6 and 7 there is shown a further embodiment of the present invention which includes the same bracket arrangement 10A as previously described in connection with FIGS. 1 through 5. The end 40 of the bracket which is turned up at the 90 degree angle has a tang pressed into the end 40 which then provides a lip extending downward towards the top of the end 12 shelf bracket has an opening thereunder. A metal shelf 56 as shown in FIG. 6 has an elongated ridge 58 along the entire length of the shelf and being adapted to be placed under the tang 52 this is then used to hold the shelf into place. The other end of the shelf 60 is turned downwardly at a sufficient radius to match the outside radius of the area 28 after the shelf bracket has been bent.

Specifically what has been shown by the present invention and the description heretofore set forth in an article of manufacture which comprises an elongated strip in the form of a metal strap which may be galvanized and formed by stamping operations. It has an improved rigidity and strength by the bead being pressed into the elongated strip. Two pairs of dimples provide a small radius so that it lends itself to the strength of the bracket.

Most prior art brackets require a wall plate which is a metal strap that is bolted directly to the wall. The present invention eliminates the need for this wall plate.

The dimples provide and insure a straight bend and smaller radius for increased strength.

The advantage of the present invention is that the brackets are built and constructed in a straight condition so that they are easier handling and cheaper to package.

On the other hand the bend can be made at any angle necessary so that if they are bent slightly more than 45 degrees they can be used for storing of round tubular metal such as pipes and other objects. If the bend is less than the 45 degree angles they can be used for displaying merchandise on a plate that is sloped downwardly.

Having thus described what is one preferred embodiment of this invention what is claimed is:

1. A bendable bracket including:

an elongated strip having a pair of elongated beads therein, said bracket having an upturned first end and an upturned second end and a bend area, said bend area including a first pair of dimples and a second pair of dimples spaced apart and aligned on opposite sides of said bend area.

2. A shelf bracket being user bendable including:

an elongated strip of metallic material, said strip having a first end and a second end, said first end being bent approximately 90 degrees from said strip and said second end being bent less than 90 degrees from said strip;

a bend area, said bend area being position less than half the distance from the first end of said strip;

a first elongated reinforcing bead impressed in said strip extending from said first end to said bend area;

a second elongated reinforcing bead impressed in said strip extending from said second end to said bend area, whereby said bend area being void of a reinforcing bead;

a first pair of dimples impressed in said strip on one side of said bend area and each dimple of said first pair of dimples being spaced lateral to said strip; and a second pair of dimples impressed in said strip on the other side of said bend area and each dimple of said second pair of dimples being spaced lateral to said strip, said first pair of dimples being spaced from said second pair of dimples, whereby said elongated strip being bendible in said bend area between said first pair and said second pair of dimples by a predetermined radius.

3. The shelf bracket as defined in claim 2 and further including a shelf holding tang extending outward from said first end of said strip a predetermined distance and downward thereafter for holding a shelf therein.

4. The shelf bracket as defined in claim 3 and further including a shelf having a first end with an upwardly extending ridge adapted to be placed under said tang and a second end with a downward curved edge having a radius which is adapted to match the radius of said strip of said bend area.

5. A user bendable shelf bracket including:

an elongated strip, said strip having a first end and a second end;

a bend area, said bend area being positioned less than half the distance from the first end of said strip;

a first elongated reinforcing means in said strip extending from said first end to said bend area;

a second elongated reinforcing means in said strip extending from said second end to said bend area, said first elongated reinforcing means being disposed in tandem with said second elongated reinforcing means; and means disposed at said bend area for assuring a substantially small radius bend at said bend are when said elongated strip is bent at said bend area, said last mentioned means including a first pair of dimples impressed on one side of said bend area and a second pair of dimples impressed on the other side of said bend area.

6. The bracket as defined in claim 5 wherein said first reinforcing means including a first bead impressed in said strip along the longitude of said strip between said first end and said bend area and said second reinforcing means including a second bead impressed along the longitude of said strip between said second end and said bend are, said first bead and said second bead being substantially longitudinally aligned with each other.

7. The bracket as defined in claim 5 wherein said first end being bent approximately 90 degress from said strip and said second end being bent less than 90 degrees from said strip.

8. A shelf bracket being adapted to be secured to a vertical wall, said bracket including:

an elongated strip having a first end and a second end;

a bend area, said bend are being positioned less than half the distance from the first end of said strip, said strip being adapted to be bent at said bend area whereby said first end is disposed horizontal to said vertical wall and said second end extends downwardly from this outer extremity of said first end and at an angle therefrom downwardly to said vertical wall;

a first reinforcing means in said strip extending from said first end to said bend area;

a second elongated reinforcing means in said strip extending from said second end to said bend area, said first elongated reinforcing means being disposed in tandem with said second elongated reinforcing means;

means disposed at said bend area for assuring a substantially small radius bend at said bend area;

a shelf holding tong extending outwardly from said first end of said strip a predetermined distance and downwardly thereafter for holding a shelf thereon; and a shelf having a first end with an upwardly extending ridge adapted to be placed under said tong and a second end with a downwardly curved edge having a radius which is adapted to match the radius of said strip at said bend area.

9. A user bendable shelf bracket including:

an elongated strip having a first end and a second end;

a bend area, said bend area positioned less than half the distance from the first end of said strip;

a first elongated reinforcing means in said strip extending from said first end to said bend area;

a second elongated reinforcing means in said strip extending from said second end to said bend area, said first elongated reinforcing means being disposed in tandem with said second elongated reinforcing means; and means disposed at said bend area for assuring a substantially small radius bend at said bend area when said elongated strip is bent at said bend area, said means including a first pair of dimples impressed in said strip on one side of said bend area, each dimple in said first pair being spaced lateral to said strip, and a second pair of dimples impressed in said strip on one side of said bend area, each dimple in said second pair being spaced lateral to said strip whereby said elongated strip being bendable in said bend area between said first pair of dimples and said second pair of dimples.

* * * * *